United States Patent [19]

Foster et al.

[11] Patent Number: 4,936,493

[45] Date of Patent: Jun. 26, 1990

[54] ELASTOMERIC VALVE AND PISTON STRUCTURE FOR PRODUCT DISPENSER

[75] Inventors: Donald D. Foster; David G. Moore, both of Lee's Summit, Mo.

[73] Assignee: Calmar, Inc., Lee's Summit, Mo.

[21] Appl. No.: 124,298

[22] Filed: Nov. 23, 1987

[51] Int. Cl.[5] ..... B65D 37/00

[52] U.S. Cl. ..... 222/209; 222/213; 222/385; 222/387; 222/494; 222/400.5; 222/556; 137/846

[58] Field of Search ..... 222/206, 207, 209, 212, 222/213, 214, 372, 380, 383, 385, 386, 387, 389, 391, 340, 341, 491, 493, 494, 556, 400.5, 256, 257, 259; 137/846, 847, 849

[56] References Cited

U.S. PATENT DOCUMENTS

| | | | |
|---|---|---|---|
| 3,088,636 | 5/1963 | Spatz . | |
| 3,162,334 | 12/1964 | Miller | 222/207 |
| 3,211,340 | 10/1965 | Zander et al. . | |
| 3,987,938 | 10/1976 | Cooprider et al. | 222/209 |
| 4,394,939 | 7/1983 | Thor et al. | 222/207 |
| 4,402,431 | 9/1983 | Wiegner et al. | 222/207 |
| 4,485,943 | 12/1984 | Czech | 222/380 |
| 4,511,068 | 4/1985 | Bossina . | |
| 4,564,130 | 1/1986 | Eulenburg | 222/207 |
| 4,565,306 | 1/1986 | Nakanishi et al. | 222/383 |
| 4,629,097 | 12/1986 | Moore | 222/387 X |
| 4,646,945 | 3/1987 | Steiner et al. | 222/207 |
| 4,684,044 | 8/1987 | Foster | 222/400.5 X |
| 4,691,847 | 9/1987 | Ford et al. | 222/259 |
| 4,699,300 | 10/1987 | Blake | 222/494 |
| 4,715,518 | 12/1987 | Moore | 222/386 X |
| 4,747,517 | 5/1988 | Hart | 222/145 X |

FOREIGN PATENT DOCUMENTS

| | | | |
|---|---|---|---|
| 0013691 | 10/1979 | European Pat. Off. . | |
| 0214106 | 3/1987 | European Pat. Off. . | |
| 2585439 | 1/1987 | France | 222/383 |
| 540733 | 3/1956 | Italy | 222/494 |
| 2083142 | 3/1982 | United Kingdom | 222/385 |
| 2161222 | 1/1986 | United Kingdom . | |
| 8604984 | 8/1986 | World Int. Prop. O. | 222/209 |

*Primary Examiner*—Joseph J. Rolla
*Assistant Examiner*—David H. Bollinger
*Attorney, Agent, or Firm*—Hovey, Williams, Timmons & Collins

[57] ABSTRACT

An elastomeric piston member of a product dispenser for semi-viscous liquids includes integrally molded priming valve structure as well as check valve structure. The priming valve comprises a number of generally flat, triangular segments arranged around the periphery of an outlet conduit leading from a pumping chamber, and during a pumping stroke of the piston member, outermost tips of each segment deflect laterally to allow discharge of products from the chamber. The triangular segments are molded in an open or spaced apart orientation to facilitate manufacture, and are biased by ribs of a discharge spout toward a closed, inclined orientation in contact with adjacent segments once the dispenser is assembled.

12 Claims, 1 Drawing Sheet

ELASTOMERIC VALVE AND PISTON STRUCTURE FOR PRODUCT DISPENSER

BACKGROUND OF THE INVENTION

1. Field of the Invention

The present invention relates to a product dispenser having an integral piston, check valve and priming valve structure for dispensing semi-viscous products.

2. Description of the Prior Art

Various types of disposable product dispensers for gels, creams, lotions and the like are available and are normally fabricated from inexpensive, synthetic resinous materials. In general, product dispensers of this nature are either provided with a single chamber which may be pressurized to discharge products directly through an outlet passageway, or alternatively are provided with two chambers wherein a larger chamber or reservoir stores products as needed until withdrawn into a smaller pumping chamber which may be pressurized for discharge of the products. In many of the known single chamber and dual chambers dispensers, the products are pumped by means of a relatively stiff, somewhat cylindrical piston that is moveable during a pumping stroke along a central axis of a cylindrical chamber to pressurize the contents and thereby force the products through an outlet passageway. A metallic compression spring is often provided to automatically shift the piston and the associated actuator upwardly along a return stroke upon completion of the pumping stroke.

In recent times, flexible, one-piece pumping membranes or pistons have been developed as an alternative to relatively stiff piston and spring assemblies. Flexible pistons of this type often have a normally hemispherical or dome-shaped configuration defining a product chamber therebeneath, and depression of the dome either directly or by means of an actuator collapses wall portions of the dome and reduces the volume of the chamber to thereby expel products within the chamber through an outlet passageway. Two examples of flexible pistons of this type are shown in European Patent Publication No. 0,214,106, published Mar. 11, 1987 and Great Britain Pat. No. 2,161,222A, published Jan. 8, 1986.

The flexible piston member described in European Patent Publication No. 0,214,106 is utilized in a single chamber pump dispenser and functions in cooperation with an independent take-up piston defining the bottom of the chamber. After products are pumped from the chamber, the take-up piston moves upwardly during the return stroke of the piston to reduce free space within the chamber. Take-up pistons of this type are often provided with gripping structures such as metallic teeth to avoid downward, retrograde movement of the take-up piston during the pumping stroke, but unfortunately the manufacture of such teeth presents certain problems which cannot be easily overcome.

In contrast, the take-up piston in the reservoir chamber of dual chamber product dispensers is somewhat easier to manufacture inasmuch as grippers or teeth for resisting retrograde movement of the take-up piston are not normally needed. Instead, a check valve separating the pumping chamber and the storage chamber of dual chamber dispensers is provided to generally preclude pressure developed in the pumping chamber from reaching the reservoir and the take-up piston therein.

Dual chamber dispensers often also have a valve which is disposed within an outlet passageway leading from the pumping chamber and which functions as a priming valve to facilitate withdrawal of products from the storage chamber during retraction of the piston. The priming valve may be in the nature of a flapper or toilet seat valve as shown in the dual chamber dispenser described in the aforementioned British Pat. No. 2,161,222A.

However, the passage of semi-viscous liquids past flapper or toilet seat valves is somewhat hindered in practice because the liquids must travel in a somewhat tortuous path around the edge of the valve which, in turn, cannot readily open unless sufficient free space is available on the downstream side of the valve. Moreover, priming valves of this type usually consist of a single flap which is integrally connected to adjacent, fixed structure along a single hinge axis and the elastomeric materials comprising the hinge and flap often do not alone present a sufficient amount of biasing force to ensure reliable closure of the flap for priming the chamber during the return stroke of the piston.

In addition, there is a continuing need to simplify the manufacture and assembly of disposable product dispensers. Preferably, the number of separate components of the dispenser should be minimized, and the use of metallic elements such as springs or teeth should be avoided. Another critical consideration, however, is the desirability for the actuating force necessary for dispensing semiviscous liquids to be as small as practical.

SUMMARY OF THE INVENTION

The present invention overcomes the disadvantages noted hereinabove by provision of a simplified, one-piece structure which functions as a priming valve, check valve, and pumping piston for the dispenser. The structure, being integrally molded of an elastomeric material, has a configuration especially adapted for reliable operation over extended periods and requires only a relatively small amount of actuating force to dispense products from the pumping chamber.

In more detail, the piston or pumping member of our present invention takes the form of an elastomeric body having lower, hemipherical wall portions defining a generally dome-shaped pumping chamber, as well as an upright conduit that is connected to an upper, central region of the hemispherical wall portions. A number of independently shiftable, triangular wall segments are coupled to an upper end of the conduit around the periphery thereof and are molded in an open or spaced orientation relative to each other in generally parallel alignment with a central axis of the conduit.

During assembly of the dispenser, the upper end of the piston member is inserted within a passage formed in a discharge spout. The triangular wall segments at the upper end of the conduit come into contact with a number of fixed ribs of the spout which project into the passage, and the ribs deflect the triangular segments in such a manner that marginal edges of the segments engage the edges of neighboring segments and thereby form a seal.

Thereafter, the ribs continuously bias the triangular wall segments toward a closed, inclined position so that priming of the dome-shaped chamber can readily occur during the return stroke of the piston. However, the ribs are configured for contact with only a lower portion of each triangular segment, and upper or outermost portions of each segment are free to deflect laterally under the influence of pressure developed during a pumping stroke of the piston and allow dispensing of products from the chamber.

The elastomeric piston body in accordance with the principles of the present invention can be easily fabricated because the triangular priming valve segments are molded in an open orientation. As a consequence, access is provided to interior reaches of the piston body during the molding operation. In contrast, elastomeric valves of conventional dispensers are normally molded in their closed orientation (unless a spring is provided for closure of the valve) and thus both a priming valve and a check valve could not be integrally formed as part of a hypothetical piston body on opposite ends of a tubular conduit since access to both sides of such valves during molding would be substantially precluded.

DETAILED DESCRIPTION OF THE DRAWINGS

Figure 1:
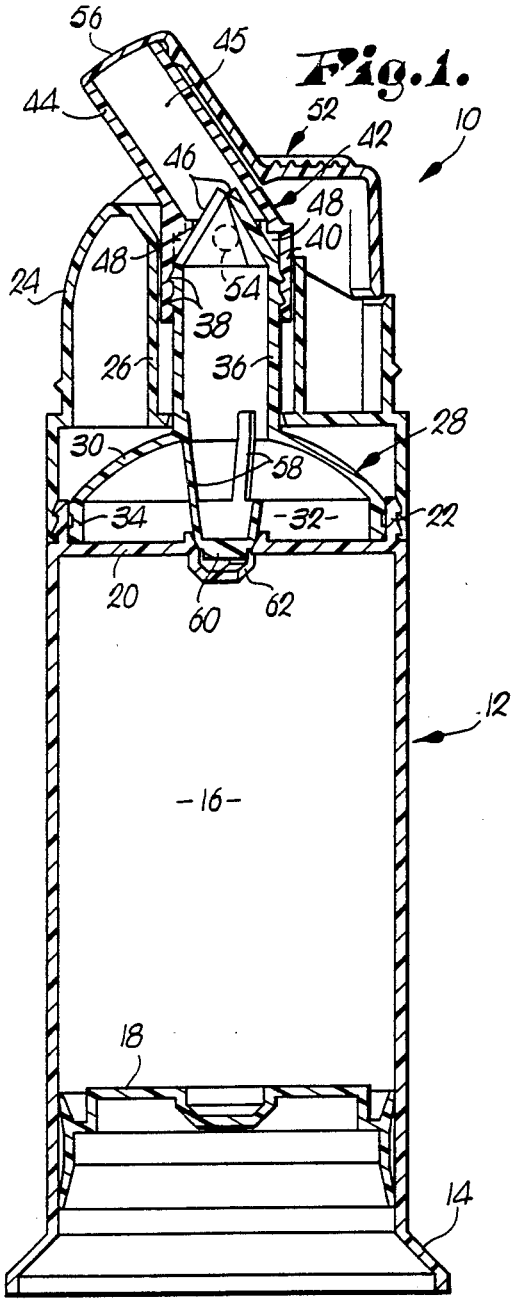
FIG. 1 is a side cross-sectional view of a product dispenser of the present invention, showing an outer housing, elastomeric piston member, discharge spout and actuator.
Figure 2:
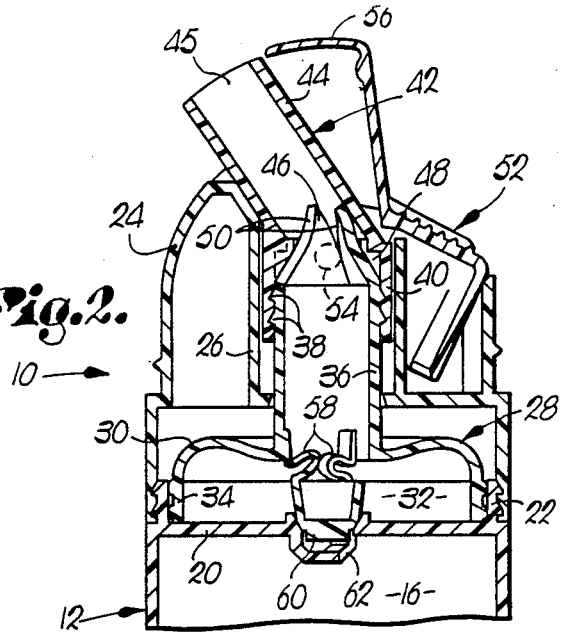
FIG. 2 is a fragmentary, cross-sectional view somewhat similar to FIG. 1 except that the actuator has been depressed to deflect wall portions of the piston member and pump products, thereby causing triangular wall segments of priming valve structure to open and allow discharge of products.

A product dispenser 10 as shown in FIGS. 1 and 2 includes an upright, tubular housing 12 having an enlarged base 14 and internal structure defining a generally cylindrical product reservoir 16. As illustrated in FIG. 1, a lower, free-floating piston 18 is shiftable along the central axis of reservoir 16 and defines the lower boundary of the reservoir 16 which is normally filled with semi-viscous products to be dispensed such as lotions, creams, gels and the like.

A horizontal wall 20, as illustrated in FIGS. 1 and 2, defines an upper end of the product reservoir 16, and an upstanding, cylindrical ribbed flange 22 is integrally fixed to the top of wall 20. A shroud 24 is snap-fit over flange 22, and includes an inner, generally cylindrical wall 26 extending along an axis coincident with the central axis of reservoir 16.

Structure defining a piston and valve arrangement for dispenser 10 comprises a piston member 28 which preferably takes the form of an integral body molded of an elastomeric, synthetic resinous material. The piston member includes lower, generally hemispherical wall portions 30 which define a dome-shaped chamber 32 separate from reservoir 16. The hemispherical wall portions 30 terminate in a cylindrical section 34 in contact with an inner surface of upstanding flange 22.

Figure 5:
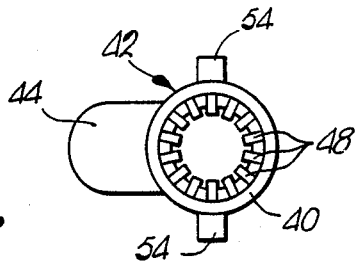
FIG. 5 is a bottom view of the dispenser spout shown in FIGS. 1–3, depicting interior, projecting ribs which are provided for biasing the triangular priming valve segments toward a closed position.

Piston member 28 further includes a hollow, cylindrical conduit 36 which is in communication with chamber 32 and which is integrally connected to the hemispherical wall portions 30 at a location adjacent a central, upper region of chamber 32. An upper portion of the upright conduit 36 includes two circumscribing, peripheral ribs 38 that are received in snap-fit fashion into corresponding, mating, inner grooves of a lower, vertical cylindrical region 40 of a discharge spout 42. The discharge spout 42 also has structure defining an uppermost cylindrical region 44 integrally connected to region 40 and extending at a angle inclined from region 40 (see also FIG. 5).

Three triangular segments 46 are integrally connected to the top of conduit 36 of piston member 28, and are arranged around the periphery of a circular outlet opening presented at the upper end of conduit 36. The segments 46 are generally flat and independently shiftable in lateral directions, and further each include an apex located at the top of piston member 28. Segments 46 extend into a discharge passage 45 extending through region 44 of spout 42.

The discharge spout 42 is formed with a number of vertically oriented ribs 48 that extend from cylindrical region 40 into region 44. An inwardmost, flat wall of each rib 48 is inclined from vertical as shown in FIGS. 1 and 2, and the inwardmost, flat edges of the spaced ribs define the bounds of an imaginary, truncated cone. The inwardmost walls of ribs 48 contact a lower portion of wall segments 46 once the piston member 28 is inserted into the spout 42 during assembly of dispenser 10.

The ribs 48 of the discharge spout 42 represent structure engageable with a portion of the triangular segments 46 for biasing the segments 46 toward respective positions of contact with adjacent segments 46. Specifically, ribs 48 cause marginal edges 50 of each segment 46 to contact the marginal edges 50 of the adjacent segments 46 and thereby substantially close communication between discharge passage 45 and chamber 32 as well as the cylindrical passageway within conduit 36.

The dispenser 10 is provided with an actuator 52 pivotally mounted on a pair of opposed, horizontally extending fulcrum pins 54 of spout 42 (FIG. 5), one of which is shown in phantom in FIGS. 1 and 2. The structure and operation of actuator 52 can be better understood by reference to co-owned U.S. Pat. No. 4,684,044, the disclosure of which is hereby incorporated by reference herein. In brief, depression of actuator 52 initially causes a covering flap portion 56 of actuator 52 to shift away from a discharge opening of passage 45, and further depression of actuator 52 exerts a downwardly biased force on pins 54 to urge the spout 42 downwardly along and within wall 26 of shroud 24.

The upright conduit 36 of piston member 28 moves simultaneously with downward shifting movement of discharge spout 42, and causes deflection of the hemispherical wall portions 30 in the manner that is illustrated in FIG. 2. Upon release of finger pressure on actuator 52, however, the inherent memory of the deflectable, hemispherical wall portions 30 urges the conduit 36 upwardly for return of the piston member 28 toward its normal orientation shown in FIG. 1.

In accordance with the embodiment shown in FIGS. 1 and 2, check valve structure includes three spaced, depending legs 58 connected to the top of the hemispherical wall portions 30 adjacent the lower end of cylindrical section 34. A valve component 60 is coupled to the lower end of each leg 58, and is received in an opening 62 formed in horizontal wall 20. The valve component 60 is seated in the opening 62 in both FIGS. 1 and 2, and during depression of the actuator 52 as shown in FIG. 2 the legs 58 deflect inwardly to accommodate downward movement of the piston member 28. During the return or upward stroke of piston member 28, however, the component 60 lifts away from opening 62 to admit products from the reservoir 16 into chamber 32.

Normally, and as shown in FIG. 1, the generally flat, triangularly segments 46 extend in a direction along respective inclined axes, with the apex of each segment 46 in contact with the apexes of the remaining segments 46 once the dispenser 10 is assembled. However, depression of the actuator 52 as illustrated in FIG. 2 causes shifting of the hemispherical wall portions 30 and a reduction of volume within chamber 32, and thereby products are forced upwardly through conduit 36 and toward the segments 46. As a consequence, the uppermost, free portion of each segment 46 is deflected away from neighboring segments 46 and the central axis of conduit 36 to open and enable discharge of the products toward passage 45. Upon release of actuator 52, however, the inherent memory of each segment 46 causes the uppermost portion of the same to return toward their normal orientation as is depicted in FIG. 1.

Figure 3:
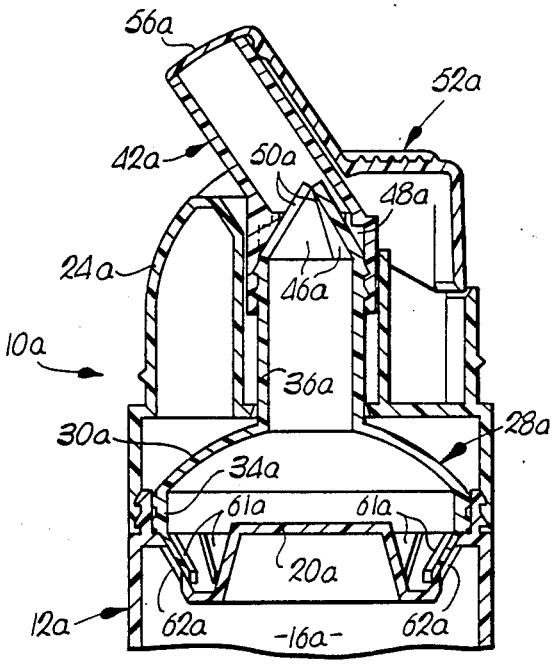
FIG. 3 is a view somewhat similar to FIG. 1 but showing a different embodiment of the invention wherein check valve structure comprises a plurality of independently shiftable, depending wall elements formed as part of the piston member in contrast to the single, centrally disposed check valve element shown in FIG. 1.
Figure 4:
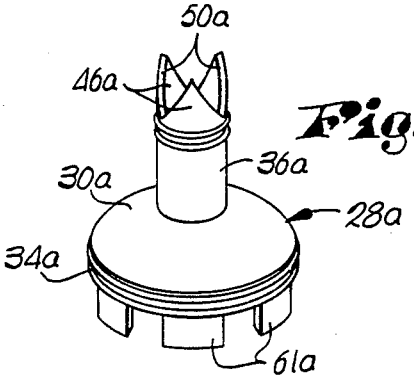
FIG. 4 is a perspective view of the piston and valve member illustrated in FIG. 3.

In the embodiment shown in FIGS. 3 and 4, dispenser 10*a* is similar in certain respects to the dispenser 10 shown in FIGS. 1 and 2, and includes a housing 12*a*, shroud 24*a* and discharge spout 42*a* that are essentially identical to like-numbered components in FIGS. 1 and 2. Piston member 28*a* as illustrated in FIGS. 3 and 4 includes hemispherical wall portions 30*a* and conduit 36*a*, as well as three independently shiftable, triangular, generally flat segments 46*a* which are biased by ribs 48*a* of spout 42*a* toward a closed position with marginal edges 50*a* of each segment 46*a* in contact with marginal edges 50*a* of adjacent segments 46*a* in order to prime chamber 32*a* during a return stroke of piston member 28*a*.

However, piston member 28*a* of FIGS. 3 and 4 differs from piston 28 of FIGS. 1 and 2 in that the piston member 28*a* has check valve structure which comprises a plurality of independently shiftable wall elements 61*a* that depend from the hemispherical wall portions 30*a* at locations spaced around the lower periphery, or cylindrical section 34*a* of the same. The wall elements 61*a* are curved in horizontal sectional view in somewhat complemental relationship to the curvature of cylindrical section 34*a*. As shown in FIG. 3, the wall elements 61*a* fit within the confines of an annular channel formed in a wall 20*a* separating a product reservoir 16*a* from chamber 32*a* below hemispherical wall portions 30*a*.

Each of the wall elements 61*a* normally covers a complemental opening formed in an inclined portion of the annular channel of wall 20*a*. During a return stroke of piston member 28*a*, the independently shiftable wall elements 61*a* move radially inwardly to admit products from reservoir 16*a* into chamber 32*a*. During a pumping stroke of piston member 28*a*, the pressure created within chamber 32*a* causes each of the wall elements 61*a* to sealingly engage the inclined, outer portion of the annular channel formed in wall 20*a* to cover a corresponding opening and substantially preclude reverse flow of products from chamber 32*a* back into reservoir 16*a*, so that instead the products will be forced past the segments 46*a* which open in a manner identical to that described in reference to segments 46 of FIGS. 1 and 2.

In both embodiments of the invention, the piston member 28 or 28*a* is preferably comprised of a thermoplastic polyester elastomer. In this regard, good results have been observed in practice by the use of a polyester elastomer manufactured by Du Pont Company under the trade name HYTREL 4056, which is a copolyester containing both polyether and polyester segments. HYTREL 4056 has a flexural modulus of 55 MPa (8,000 PSI) and a durometer hardness of 40D. This particular elastomer exhibits high resilience, excellent flexibility at room temperatures and excellent flex crack resistance, as well as excellent resistance to stress relaxation and creep.

It should now be apparent that the piston member 28, 28*a* represents an improvement over prior practice because a single, molded component or member 28 functions as a check valve, priming valve, piston and spring. The three triangular priming valve segments 46*a* are molded in an open or spaced apart configuration as depicted in in FIG. 4, and thus piston member can be easily molded while access is provided to interior regions of the component. Once the dispenser 10 is assembled, however, ribs 48 bias the segments 46 toward their closed configuration as shown in FIG. 1 to thereby establish a seal to facilitate priming of chamber 32 during an upward, return stroke of piston member 28.

When the product to be dispensed is of a relatively high viscosity such as approximately 79,000 centipoise or above, part or all of the segments 46 may be removed in order to reduce the force necessary to actuate piston member 28. Under these circumstances, the product is normally sufficiently viscous to close conduit 36 during a return stroke of piston member 28 and enable products to be withdrawn from reservoir 16 and into chamber 32.

We claim:

1. A product dispenser comprising:

a housing having structure defining a product reservoir and a plurality of spaced apart reservoir openings, each of said openings including a peripheral edge;

a piston member coupled to said housing and comprised of an elastomeric material;

said member including wall portions at least partially defining a chamber normally separate from said reservoir;

said wall portions of said member being deflectable through a pumping stroke and a return stroke;

first valve means for permitting the flow of products from said reservoir and into said chamber during said return stroke of said piston member, and for substantially precluding the return flow of products from said chamber and into said reservoir during said pumping stroke of said piston member, said first valve means including a plurality of independently shiftable and spaced apart wall elements depending from said wall portions;

each of said plurality of wall elements being shiftable between a first position overlying and covering (seated around) the peripheral edge of one said plurality of reservoir openings, and a second position spaced from said one of the reservoir openings;

said member including structure defining the periphery of an outlet opening for enabling the discharge of products from said chamber during said pumping stroke;

said member further including second valve means having a plurality of independently shiftable segments connected to said periphery of said outlet opening, said segments being arranged around the periphery of said outlet opening;

and a deflecting member surrounding the periphery of said outlet opening for biasing each of the segments toward respective positions of contact with adjacent segments for generally closing said outlet opening, said segments being simultaneously shiftable during said pumping stroke in respective, lateral directions away from each other for opening said outlet opening and enabling the discharge of products from said chamber.

2. The invention as set forth in claim 1, wherein each of said segments is of a generally triangular configuration and presents an apex disposed approximately at the center of said outlet opening.

3. The invention as set forth in claim 2, wherein said segments are generally flat and normally extend in a direction inclined from the direction of discharge of products through said outlet opening.

4. The invention as set forth in claim 1, wherein each of said segments presents marginal edges, and wherein the edges of each segment are normally in contact with the marginal edges of adjacent segments.

5. The invention as set forth in claim 1, further comprising a discharge spout disposed downstream of said outlet opening, said deflecting member being provided on said discharge spout.

6. The invention as set forth in claim 1, wherein said outlet opening is of a generally circular configuration, and wherein said segments are of a generally flat, triangular configuration normally inclined with respect to the plane of said circular opening.

7. A product dispenser comprising:

a housing having structure defining a product reservoir;

a piston member coupled to said housing and comprised of an elastomeric material, said member including wall portions at least partially defining a chamber normally separate from said reservoir, said wall portions of said member being deflectable through a pumping stroke and a return stroke;

means for permitting the flow of products from said reservoir and into said chamber during said return stroke; of said piston member, and for substantially precluding the return flow of products from said chamber and into said reservoir during said pumping stroke of said piston member, said member including a tubular conduit having a central axis and being in communication with said chamber, said conduit defining the periphery of an outlet opening for enabling the discharge of products from said chamber during said pumping stroke, said member further including valve means having a plurality of independently shiftable segments connected to said periphery of said outlet opening, said segments being molded in an open, spaced apart orientation extending in a direction generally parallel with said central axis of said conduit; said segments being deflectable toward a position of contact with adjacent segments; and a discharge spout connected to said piston member for movement therewith during said pumping stroke and said return stroke, said spout including structure in contact with a portion of each of said segments and deflecting said segments toward a closed position generally covering said outlet opening, said discharge spout structure being out of contact with remaining portions of each of said segments for permitting lateral shifting of the latter during said pumping stroke to thereby enable the discharge of products from said chamber.

8. The invention as set forth in claim 7, wherein said segments are generally flat and triangular and normally extend in a direction inclined from the direction of discharge of said products through said outlet opening.

9. For use with a product dispenser, a piston member comprising:

an integral body comprised of an elastomeric, synthetic resinous material, said body including deflectable wall portions partially defining a generally dome-shaped chamber having a central, upper region, said body including a tubular conduit having a central axis, said conduit being in communication with said chamber and connected to said wall portions at a location adjacent said central, upper region of said dome-shaped chamber, said body including a number of independently shiftable segments, connected to said conduit at respective positions remote from said dome-shaped chamber, said segments being molded in an open, spaced apart orientation extending in a direction generally parallel with said central axis of said conduit, said segments being deflectable toward a position of contact with adjacent segments.

10. The invention as set forth in claim 9, said body further including check valve structure connected to said walls defining said dome-shaped chamber at a location remote from said conduit.

11. The invention as set forth in claim 10, wherein said check valve structure includes a plurality of independently shiftable wall elements depending from said wall portions at locations spaced around the lower periphery of the same.

12. The invention as set forth in claim 10, wherein said check valve structure includes at least one deflectable leg connected to said conduit in depending relation thereto, and wherein said check valve structure further includes a valve component coupled to lower regions of each of said at least one of said legs.

* * * * *